US006537024B2

(12) United States Patent
Chien et al.

(10) Patent No.: US 6,537,024 B2
(45) Date of Patent: Mar. 25, 2003

(54) METHOD FOR FABRICATING SHEET METAL PUMP CASING

(75) Inventors: Huan-Jan Chien, Hsinchu (TW); Kou-Yu Tang, Hsinchu (TW); Char-Lie Pen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 4 days.

(21) Appl. No.: 09/779,403

(22) Filed: Feb. 8, 2001

(65) Prior Publication Data

US 2001/0005484 A1 Jun. 28, 2001

Related U.S. Application Data

(63) Continuation-in-part of application No. 09/128,980, filed on Aug. 3, 1998.

(51) Int. Cl.[7] ..... F01D 1/02
(52) U.S. Cl. ..... 415/200; 415/213.1
(58) Field of Search ..... 415/200, 214.1, 415/215.1, 203, 204, 206, 212.1

(56) References Cited

U.S. PATENT DOCUMENTS 4,775,295 A * 10/1988 Starke et al. ..... 415/219 C
5,040,947 A * 8/1991 Kajiwara et al. ..... 415/206
5,112,190 A * 5/1992 Kajiwara et al. ..... 415/215.1
5,310,310 A * 5/1994 Nakatsukasa et al. .... 415/214.1
5,358,380 A * 10/1994 Arakawa ..... 415/200
6,200,090 B1 * 3/2001 Chien et al. ..... 415/172.1

* cited by examiner

*Primary Examiner*—Edward K. Look
*Assistant Examiner*—James M McAleenan
(74) *Attorney, Agent, or Firm*—W. Wayne Liauh

(57) ABSTRACT

A method of fabricating a pump casing that includes an inlet, an outlet and a pump casing body. The pump casing body has a neck portion that defines a groove. The inlet is formed by stamping a sheet of metal to form a basin-shaped body, wherein the stamping the center portion of the basin-shaped body forms the inlet. Centering the basin-shaped body about a first axis and using one set of roller dies to roll form the basin-shaped body into a pump casing body. The pump casing body includes, starting from the inlet, an inlet end plate, a passage side plate, a motor end plate and a neck portion. Stamping the passage side plate forms the outlet. A set of roller dies include an internal roller die and a mating external roller die, wherein both are rotatably mounted along a second and third axes, respectively, wherein the first, second and third axes are parallel to but spaced from each other.

10 Claims, 6 Drawing Sheets

METHOD FOR FABRICATING SHEET METAL PUMP CASING

This is a continuation-in-part of application Ser. No. 09/128,980, filed, Aug. 3, 1998.

BACKGROUND OF THE INVENTION

1. Field of the Invention

This invention relates to a sheet metal pump casing and its fabrication method and particularly to a pump casing made by roll forming of sheet metal, and having a flange reinforced structure to enhance pump casing strength, and having a guide plate for forming more effective volute.

2. Description of the Prior Art

Conventional methods for fabricating a pump casing for a centrifugal pump generally include casting and sheet metal working. The pump casing made by casting usually is relatively bulky and heavy. It takes more material and space. Because of material characteristics (cast iron), it has poor erosion resistantance and low stiffness. It is therefore less durable and is mostly used in relatively low value and price products. The pump casing made by sheet metal stamping may use high strength and high erosion resistant metal (such as stainless or alloy steel). It is lighter and smaller and more durable. However due to pump casing made by sheet metal is relatively thin, it is prone to deform under external force. Furthermore during stamping process, high stress concentration often happens at some spots of the pump casing and results in strength reduction, uneven thickness, deformation or even fracture.

In general, a pump connects with a piping system at the inlet and outlet. The piping system constantly subjects to heat expansion and cold contraction effects. The fluid pressure has wide variation. The pump impeller will generate torque during rotation. All these factors will create dynamic loads acting upon the inlet and outlet, and could result in deformation of pump casing at the inlet and outlet sections. It is therefore a constant studying subject in pump design on how to increase the strength of the inlet and outlet sections to withstand those internal and external forces and stress. PCT (Germany) patent No. PCT/DE86/00188 discloses a sheet metal pump design (shown in FIG. 1). The centrifugal pump 10 has a sheet metal pump casing 11 which is formed by a sheet metal working piece or by welding a plural number of sheet metal working pieces together. The sheet metal working pieces are made by stamping processes. The pump casing 11 near the inlet 12 is formed in ravine shape for reinforcement. However there is still some deficiencies in such construction. For instance, it is generally known that the centrifugal pump usually has a wear ring 15 located at the front end of the impeller 14 near the inlet 12. It is to keep clearance between the impeller tip and the inside wall of the pump casing 11 so that when the impeller rotates in high speed, the severe friction that might otherwise happen between the impeller and the pump casing may be avoided. The degree of clearance directly affects pump efficiency, noise level and working life of the pump. Although the pump 10 shown in FIG. 1 has reinforcement structure for the pump casing 11, the maximum force receiving location is still at the inlet 12 section. When the pump 10 subjects to high stress, torsion or torque, the pump casing 11 near the inlet 12 is easily deformed. The wear ring 15 clearance is prone to change. It could result in lower pumping efficiency or increasing noise level, or even damage the pump. It is also known that a volute will be formed between the impeller 14 and the inside wall of the pump casing 11. The volute will produce better pumping effect with increasing crosssection dimensions starting from the outlet along the rotor 14 rotation direction. This variating dimension shape is easily made by casting method but is difficult to form by stamping sheet metal working process. Therefore, in FIG. 1, the volute has a constant dimension rather than variation that is more desirable. The pumping efficiency will be lowered because of such deficiency.

European patent No. EPO-0442070A1 (Ghiotto) discloses another centrifugal pump 20 with sheet metal pump casing 21 (shown in FIG. 2). Around the inlet 22 is a flange 23. Near the flange 23 at the inlet section, there is a reinforced member 26 formed in a passage shape and relatively greater thickness than the pump casing. The reinforced member 26 is welded to the inside wall of the pump casing 21 to support high stress at the inlet section. However when the flange 23 is subjected to great external force, the wear ring clearance at the front end of the impeller 25 tends to change. Hence it will cause dropping of pumping efficiency, increasing noise level and reducing working life. Furthermore it also does not cover detailed description about the volute 27 improvement.

There have been prior cases which tried to employ multiple stamping processes on sheet metal along the volute of the pump casing for producing increasing crosssections volute. They usually need a plural number of dies and stamping operations. The total fabrication time is long and the cost is higher. Moreover excessive stamping processes could result in harmful effect on material property and structure of the pumping casing.

SUMMARY OF THE INVENTION

In view of aforesaid disadvantages, it is therefore an object of this invention to provide a sheet metal pump casing and its fabrication method for producing sheet metal pump casing with greater strength. It can also result in stable wear ring clearance at the front of the impeller and volute with increasing crosssections at low cost. The sheet metal working method according to this invention can form a pump casing with stable and steady strength without undue stress concentration or downgrade the pump casing material.

The sheet metal pump casing according to this invention includes a body, an impeller, an inlet flange and an outlet flange. The body has an inlet engaging with the inlet flange, and an outlet engaging with the outlet flange. At the inlet flange, there is provided with a first flap flange which has one end located from the peripheral of the inlet flange and another end extending to the outside wall of the body and spaced from the inlet. Around the outlet flange, there is also a second flap flange with one end extending to the outside wall of the body and connecting with the inlet flange. Because of such construction, the stress, torque and torsion applying on the inlet flange and outlet flange will not directly transmit to the body near the inlet and outlet. The first and second flap flange will receive and disperse the stress and forces to other parts of the body remote from the inlet and outlet. Therefore the wear ring clearance at the front end of the impeller will be least affected by external force.

According to one aspect of this invention, the first and second flap flange are respectively made in a double flange form and welded to body in opposite direction between the inlet (or outlet) flange and the body. The flap flange has a flap foot fixed to the body. The flap foot has the contour mating with the shape and form of the body so that the stress and force may be dispersed more evenly.

In another aspect of this invention, there is provided with a guide plate formed in an arched shape and being fixed to the inside wall of the body. The guide plate has a joint section mating and welded to the inside wall near the outlet, a cut water section and a spread section. The cut water section bridges between the joint section and the spread section with a cut water end projecting toward the impeller but spaced from it. The spread section is an elongated narrow strip with a head end connecting with the cut water section and a tail end fixing to the inside wall of the body. The middle section of the spread section is formed in curved shape around the impeller with a narrow gap at the cut water end and wider gap at the tail end. Therefore the impeller and the guide plate form a volute with increasing crosssection from the cut water end to the tail end. When the impeller rotates and pumps fluid, fluid flows in the volute and being discharged out from the outlet more smoothly. The cut water section also helps to smooth out fluid discharge through the outlet.

In yet another aspect of this invention, this invention provides a fabrication method for forming a sheet metal pump casing with above mentioned structure. The body of the pump casing is made of a basin-shaped metal. By using at least one set of roller dies in geometric shape to roll forming the basin-shaped metal, the body of the pump casing is formed with an inlet end plate, a passage side plate and a neck section. Because the roller dies form sheet metal gradually and smoothly, the stress concentration can be minimized. The harmful effect of stress concentration that occurs in conventional stamping process thus may be avoided.

In a further aspect of this invention, the aforesaid inlet end plate is made separately by a thick or high strength sheet metal and being welded to the body at the inlet section. The body, particularly at the inlet section thus may withstand higher stress and force.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
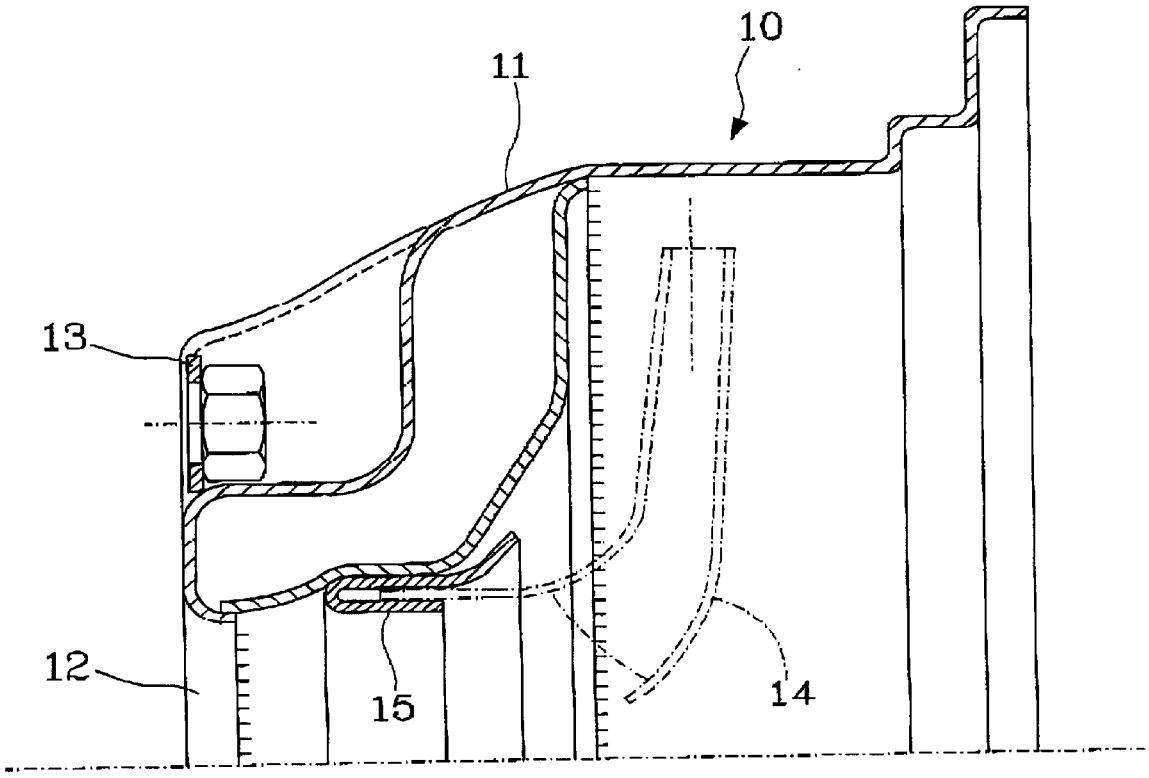
FIG. 1 (PRIOR ART)
FIG. 1 is a fragmentary sectional view of a conventional sheet metal pump casing (PCT/DE86/00188).
Figure 2:
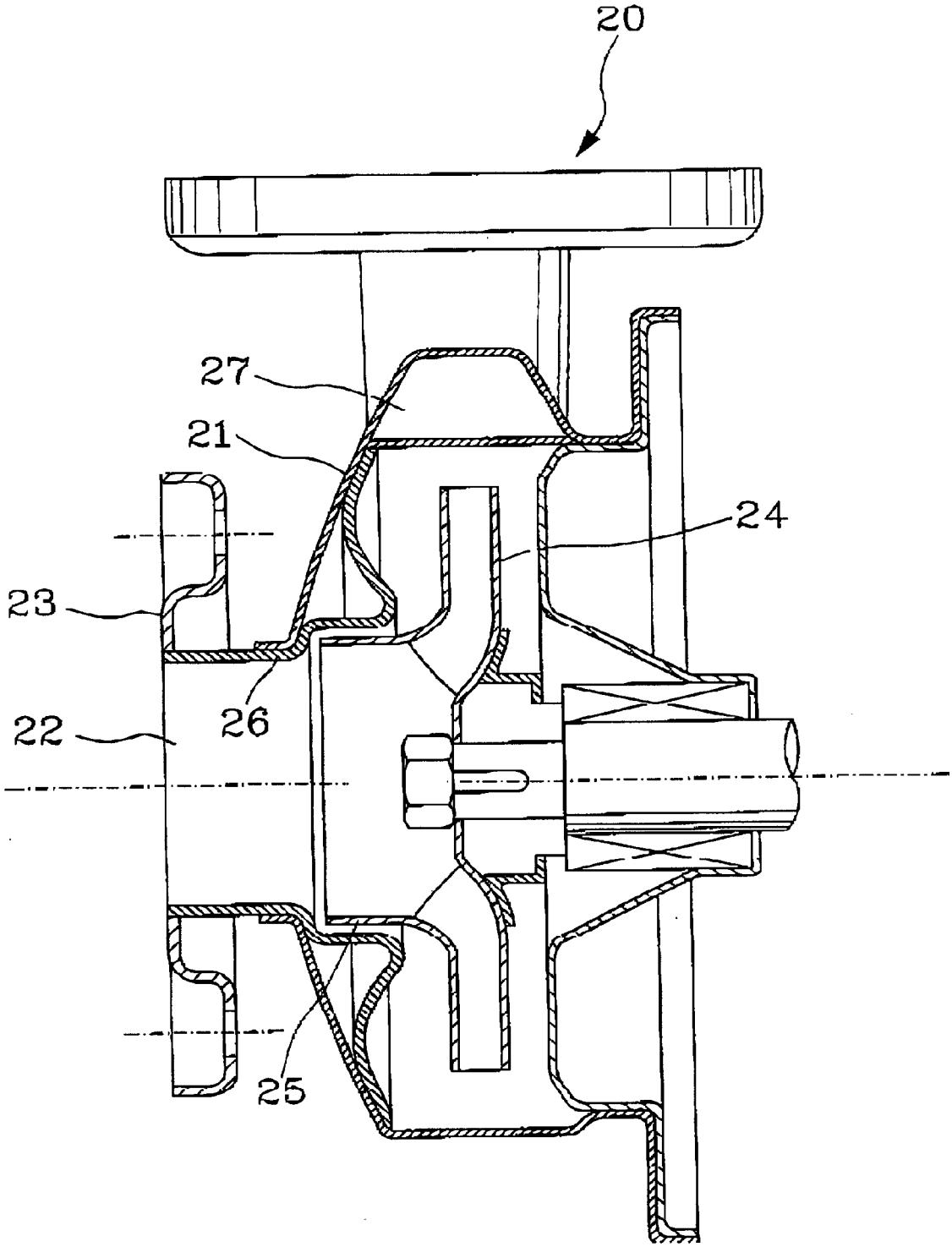
FIG. 2 (PRIOR ART)
FIG. 2 is a sectional view of another conventional sheet metal pump casing (EPO-0442070A1).
Figure 3:
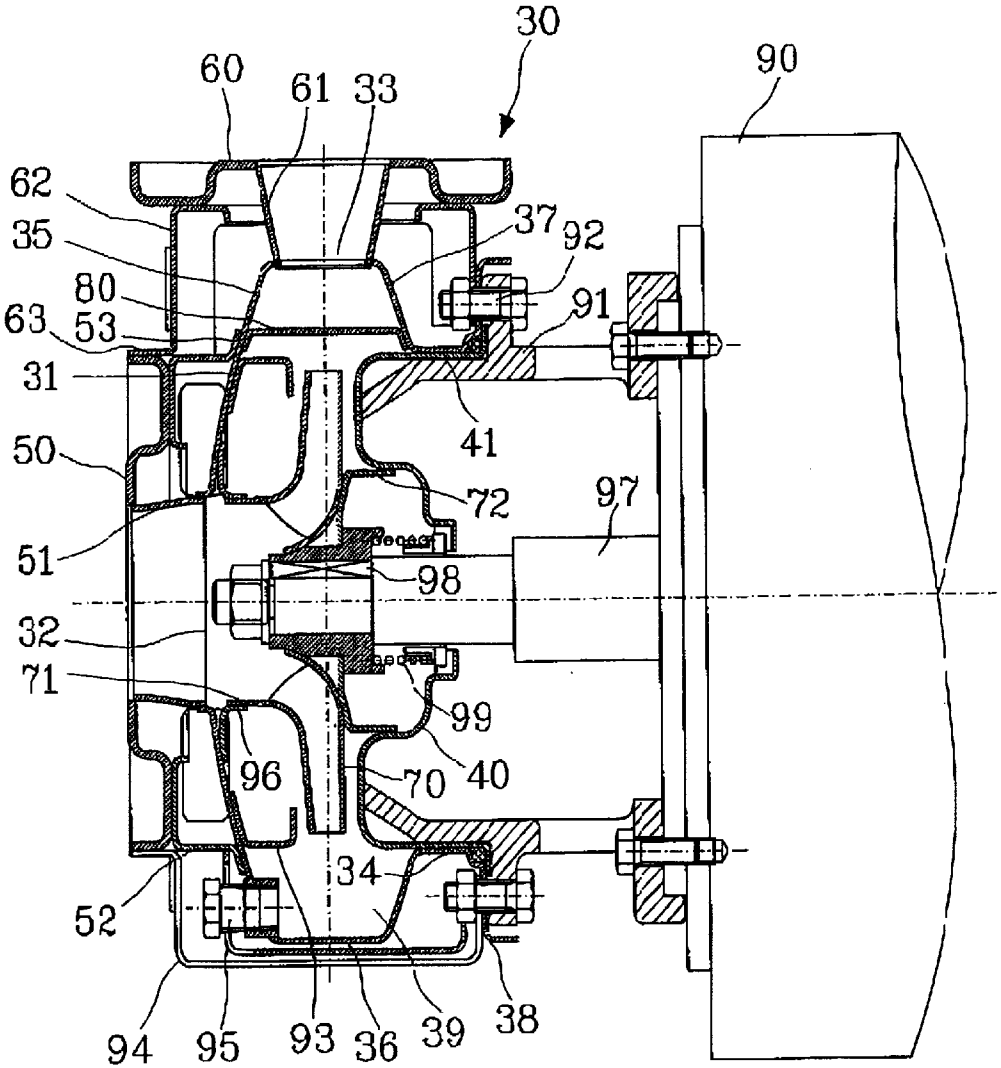
FIG. 3 is a sectional view of a preferred embodiment in accordance with the present invention.

Referring to FIG. 3, the sheet metal pump casing of the centrifugal pump 30 according to this invention generally includes a body 31, an impeller 70, a back cover 40, an inlet flange 50 and an outlet flange 60. The pump 30 is driven by a motor 90 so that the impeller 70 will be rotated within the body 31 for moving fluid. There is an inlet 32 axially located in front of the impeller 70 and an outlet 33 radically located against the impeller 70. Opposite to the inlet 32, the body 31 has a groove portion 34. The back cover 40 has a side plate 41 welded to the neck portion 34 to form a closed compartment for housing the impeller 70 in the body 31. The inside wall of the body 31 and the impeller radial perimeter forms a circular volute 39 which had a semi-circle or substantially rectangular crosssection. At the bottom of the volute 39, there is a drain bolt 95 for discharging fluid trapped in the volute 39 when necessary.

The body 31 may be an integral member and includes an inlet end plate 35, a passage side plate 36, a motor end plate 37, the neck portion 34 and a flange bracket 38. Typically, the inlet 32 is located in the center of the inlet end plate 35, and the outlet 33 is located on the top of the passage side plate 36. The inlet flange 50 has an inlet shell 51 which is welded to the inlet end plate 35 at the inlet 32 section to form a fluid inlet passage. Between the inlet flange 50 and the external wall of the body 31, there is a first flap flange 52 welded and fixed therebetween. The first flap flange 52 is welded between the inlet flange 50 and the body 31 in a direction opposite to the inlet flange 50 so as to form a double flange structure. The first flap flange 52 has a circumferential flap structure which is starting from an end adjacent to the inlet flange 50 and extending toward another end which is welded on the outside wall of the body 31. At the end of the flap structure which is welded on the body 31, a circumferential first flap foot 53 is formed thereon for mating with the geometric shape of the outside wall of the body 31. The first flap flange 52 may further be provided with a plurality of screw nuts (not shown in the pictures) for connecting with other piping systems (not shown in the pictures) by screws. At the bottom of the first flap flange 52, there is provided with a bracket frame 94 for engaging with a base (not shown in the picture).

Similarly, an outlet shell 61 is provided on the outlet flange 60 and is welded to the passage side plate 36 at the outlet 33 to form an outlet fluid passage. There is also a second flap flange 62 welded and formed between the outlet flange 60 and the outside wall of the body 31. The second flap flange 62 and the outlet flange 60 are also in double flange relationship with one flange opposite with another. The second flap flange 62 also has a circumferential flap structure extending from an end near the outlet flange 60 toward another end near the body 31. The end of the flap structure which is near to the body 31 is also formed with a circumferential second flap foot 63. Major part of the second flap foot 63 is mating and welded to the outside wall of the body 31, while having other part thereof mating and welded to the inlet flange 50 and the first flap flange 52. The second flap flange 62 may also provide with a plurality of screw nuts (not shown in the picture) for engaging with the piping systems (not shown in the picture).

Because of aforesaid construction, the inlet flange 50, outlet flange 60, first flap flange 52, second flap flange 62, bracket frame 94 and body 31 form a strong and sturdy structure which can greatly enhance the strength of the body 31 to withstand and support external forces (or torque, tension, etc). The forces applyed on the inlet and outlet flanges 50 and 60 will be dispersed to and absorbed by the first and second flap flange 52 and 62 and be further dispersed to the body 31 far away from the inlet 32 and outlet 33. Therefore the clearance at the wear ring 71 at the front end of the impeller 70 and at the wearing ring 96 located at the front end of the body 31 can be maintained without much distortion or change. Thus the pumping efficiency can be maintained without dropping under external force and the noise level may be kept at low level.

It is to be understood that the descriptions and preferred embodiments set forth above are only to serve for illustrative purpose, modifications of the disclosed embodiment of this invention as well as other embodiments thereof may occur to those skilled in the art of sheet metal pump casing fabrication. For instance the first and second flap flange 52 and 62 may be located directly in the inlet and outlet flange 50 and 60 so that both the inlet and outlet flanges have flap flange structure extending from the peripherals of inlet and outlet flanges to the body for reinforcement purpose.

FIG. 3 also shows that the impeller 70 engages with the motor spindle 97 by means of a key 98 (preferably a rectangular one). On the spindle 97, there is a mechanical seal 99 to facilitate spindle rotation. Between the motor 90 and back cover 40, there is a motor bracket 91 which supports and mounts the motor by means of screws 92 on a flange bracket 38 of the body 31. There is an impeller end plate wear ring 72 located behind the impeller 70 and near the back cover 40. At the inside wall of the body 31 and in front of the impeller 70, there is an annular constraint member 93 for guiding fluid flowing from the inlet 32 to the impeller 70, going through the volute 39 and finally being discharged through the outlet 33 out of the body 31 because of the impeller 70 rotation.

Figure 4C:
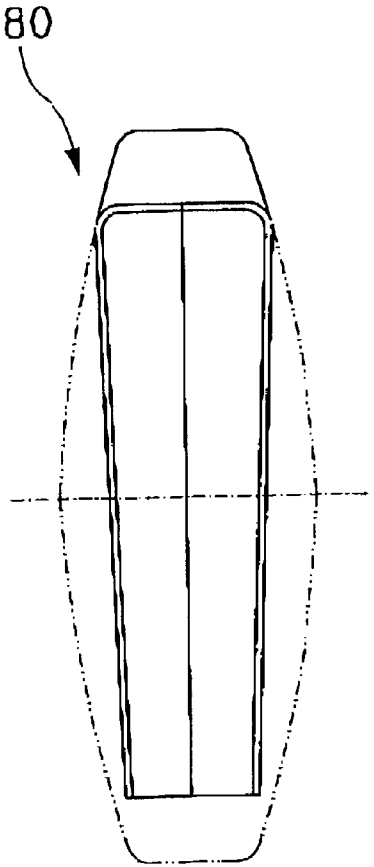
FIGS. 4A–4C are left side, front and right side views of a guide plate of this invention.
Figure 4B:
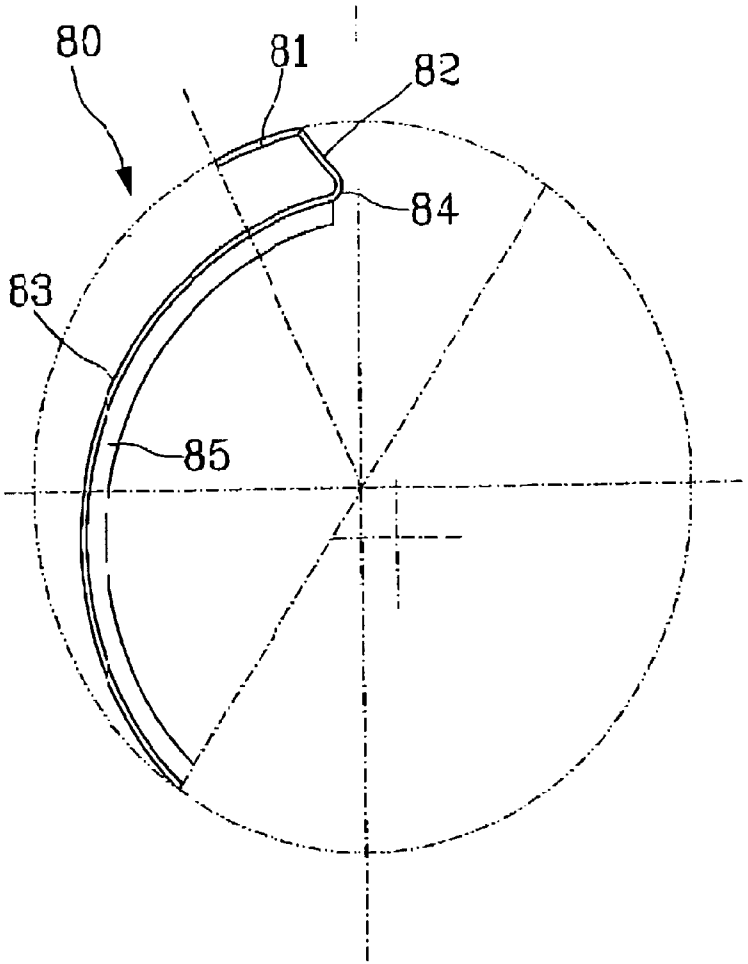
Figure 4A:
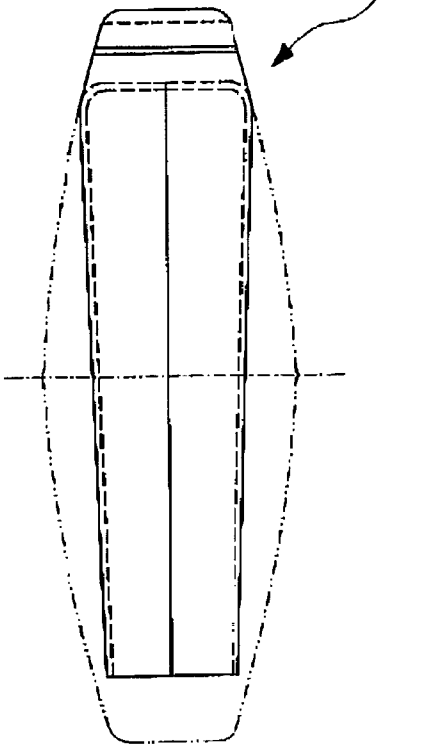

FIG. 3 further shows a guide plate 80 which is a curved and tongue shape strip member located in the volute 39 to gradually increase the crosssection of the volute 39 along the fluid flow direction for improving pumping efficiency. FIGS. 4A, 4B and 4C depict more details of this guide plate structure.

The guide plate 80 has a joint section 81 located at the passage side plate 36 around the outlet 33 and being welded to the inside wall of the body 31, a cut water section 82 connecting with the joint section 81 at one end thereof and at another end extending toward the impeller 70 but spaced from it to form a cut water end 84, and a spread section 83 which is an elongated narrow strip with one end connecting with the cut water end 84 while the strip section formed in a curved shape around the impeller 70 in the rotation direction (i.e., fluid flow direction in the volute 39) and having its tail end fixed to the inside wall of the body 31 (i.e., passage side plate 36). The strip section of the spread section 83 further has a pair of spaced ridges 85 located on two sides and extended toward the impeller 70 for channeling fluid flow in a desired passage. The cosssection formed by the volute 39 between the spread section 83 and the impeller 70 is increasing from the cut water end 84 to the tail end of the spread section 83. The fluid flows in the volute 39 thus become more smoothly. The cut water end 84 can help to smooth fluid discharging out of the outlet 33. This is a simpler and lower cost way to improve pumping efficiency than the multiple stamping formation of volute to achieve same purpose.

Figure 5:
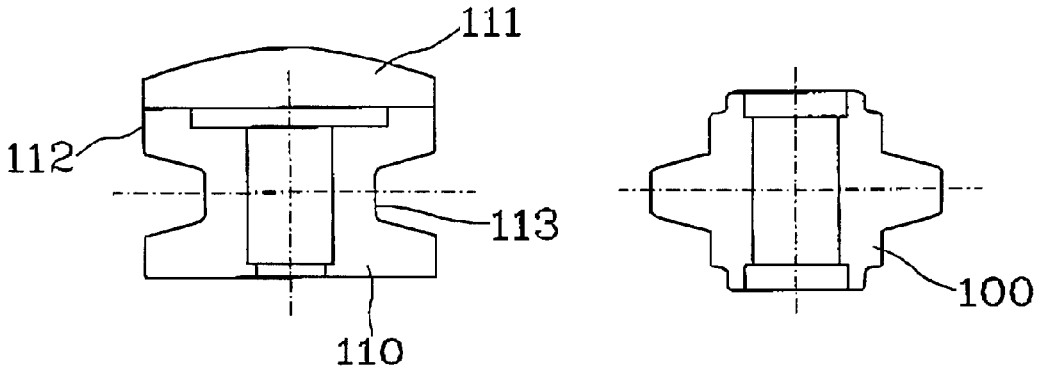
FIG. 5 is the front view of a pair of roller dies for this invention.
Figure 6A:
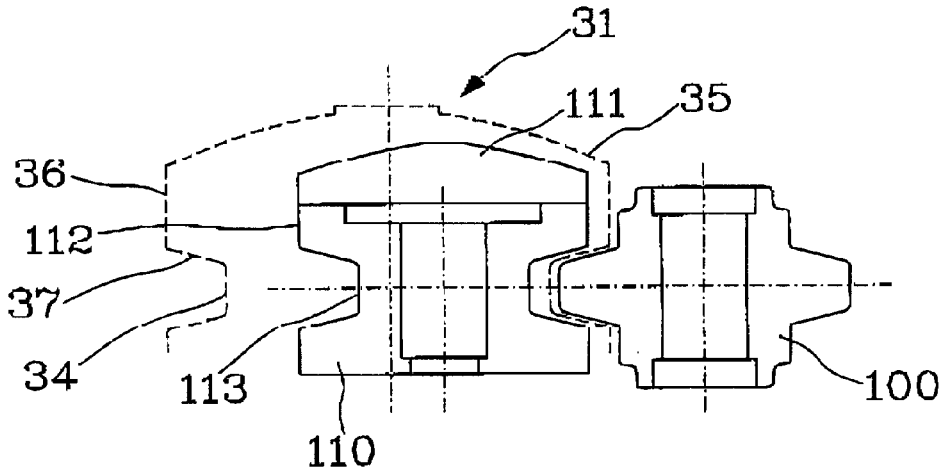
FIG. 6A is a front view of a roll forming step.
Figure 6B:
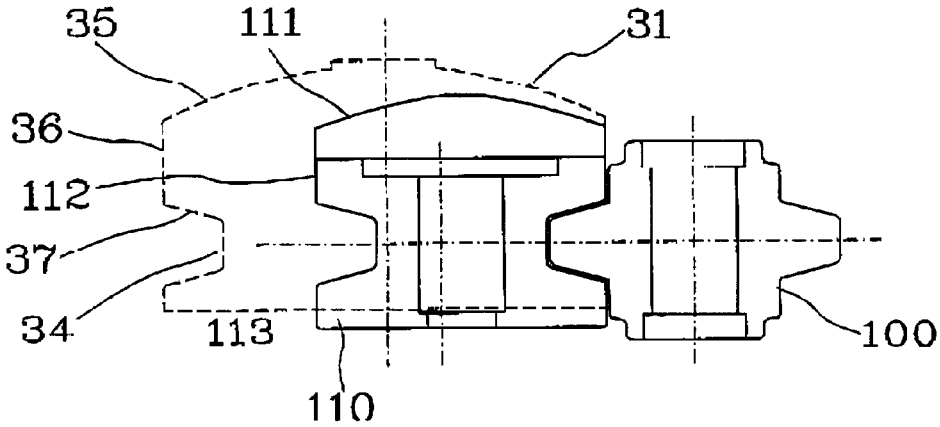
FIG. 6B is a front view of a roll forming completed step.

In order to produce the pump casing set forth before, this invention provides a fabrication method which will be elaborated in more detailed below. Referring to FIGS. 5, 6A and 6B, the pump casing for this invention is made by a basin-shaped sheet metal (preferably stainless or alloy steel) roll forming by one or more sets of geometric roller dies. During roll forming, the contour and shape of the basin-shaped sheet metal is gradually changed to the shape desired. For instance, the inlet end plate 35 is first formed, then the passage side plate 36, motor end plate 37, and the neck portion 34 to finally form the pump body 31. As the force and stress being applied to the basin sheet metal gradually and smoothly, there is no stress over concentration as conventional stamping process would otherwise do.

FIG. 5 illustrates a preferred embodiment of a roller dies set which typically includes an internal roller die 10 and an external roller die 110, wherein both of the roller dies 100, 110 have the required and corresponded geometric shapes for forming the sheet metal to a pump body. FIGS. 6A and 6B show a desired example of the roll forming processes. The internal roller die 110 has at least a head section, a side section 112 and a trough section 113. The head section 111 has a curve at the top side for producing the shape of the inlet end plate 35. The side section 112 is for forming the passage side plate 36. The trough section 113, matching a flange portion 101 of the external roller die 100 is for forming the neck portion 34, which defines a groove 34*b*. The motor end plate 37 is formed by the surface between the side section 112 and the trough section 113. While one pair of roller dies may be sufficient to form a desired shape of the pump casing body, it is more preferable to use more than one pair of the roller dies of gradually changing shapes to form the body incrementally so that the stress concentration may be reduced to a minimum level. For example, the first pair of roller dies used in the roll forming processes may have a shallower trough section, while the subsequent pairs of roller dies may gradually increase the depth of their trough section until a predetermined shape of the body is acquired.

The method of fabricating the sheet metal pump casing of this invention includes the following steps:

a. stamping (or roll forming) a sheet metal (preferably a stainless or alloy steel) to produce a basin-shaped body and stamping the center portion of the basin-shaped body to form an inlet. As the basin shape is simple, stamping process may be used without stress concentration.

b. using at least one set of geometric shape roller dies to roll forming the basin-shaped body to form a pump casing body. Starting from the inlet, the pump casing body includes at least the inlet end plate, the passage side plate, the motor end plate and the neck portion.

c. stamping the passage side plate to form an outlet.

d. welding the guide plate, annular constraint member and pump wear ring to the inside wall of the body.

e. welding the inlet flange and the first flap flange on the outside wall near the inlet and welding the outlet flange and the second flap flange on the outside wall of the body near the outlet.

It is noted that following illustrated embodiment has in general similar structure like the one described above. Therefore same numerals are used for similar type of elements.

Figure 7:
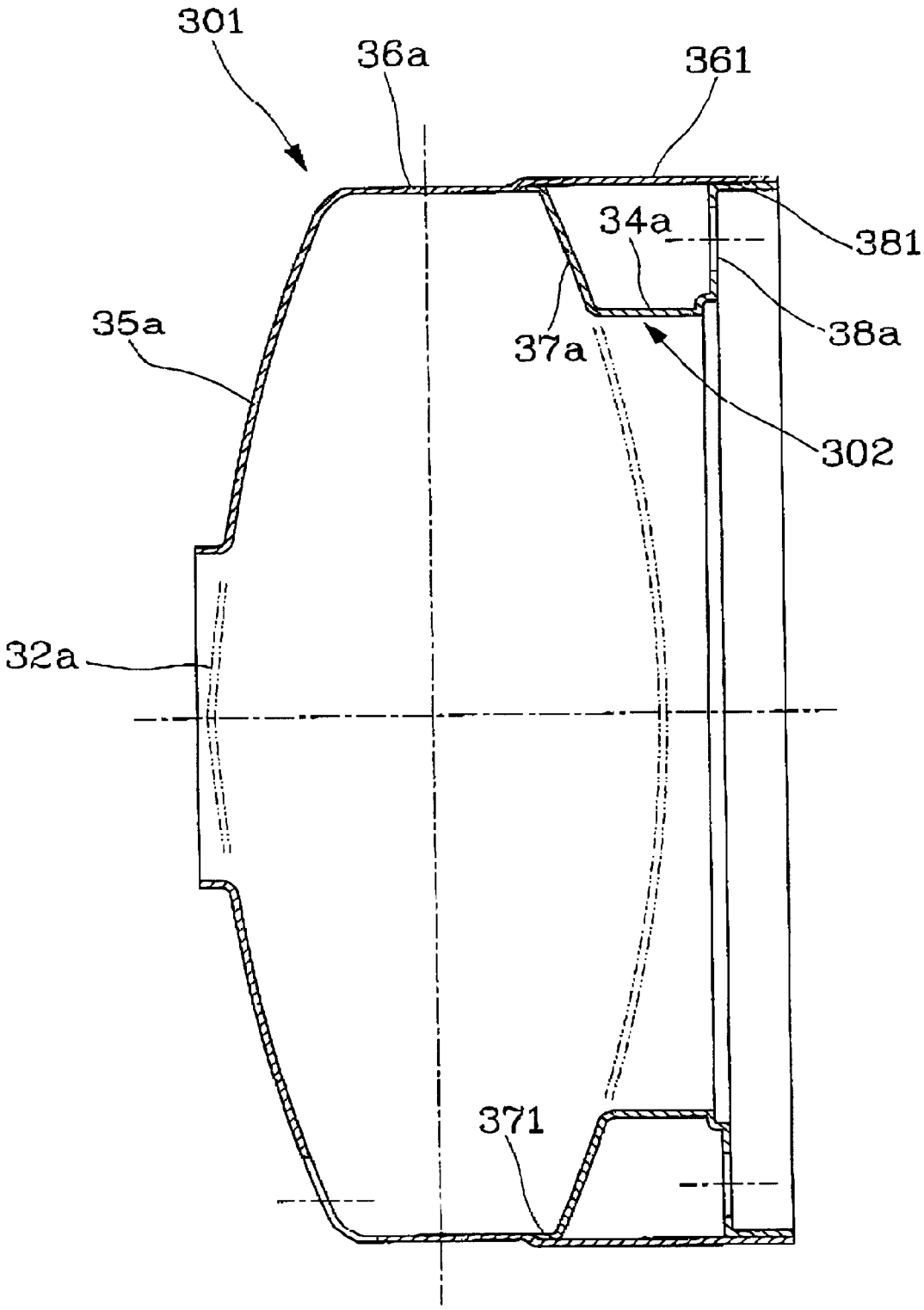
FIG. 7 is a sectional view of a second preferred embodiment of a sheet metal pump casing in accordance with the present invention.

Please refer to FIG. 7, which illustrates another embodiment of the body of the sheet metal pump casing in accordance with the present invention. An example for fabricating such body is also disclosed hereinafter. The embodiment as shown in FIG. 7 is to make the body into two separated parts, namely an outer part 301 and an inner part 302. The outer part 301 of the body may include an inlet end plate 35*a*, a passage side plate 36*a* and an extended cylindrical reinforcement casing cover 361. The casing cover 361 has an inner diameter slightly greater than which of the passage side plate 36*a*, wherein the diameter difference between the casing cover 361 and passage side plate 36*a* is preferably about the same as the thickness of the passage side plate 36*a*. An inlet 32*a* is formed at a central part of the inlet end plate 35*a*, while an outlet (not shown in this figure) is furnished at a desired position on the passage side plate 36*a*. The outer part 301 of the body is substantially of deep basin shaped which can be formed integrally by either stamping or deep drawing processes. The inner part 302 of the body may include a motor end plate 37*a,* a neck portion 34*a,* and a flange bracket 38*a,* and is preferably formed by roll forming a cylinder shaped sheet metal.

The outer diameter of the inner part 302 is the same as the inner diameter of the casing cover 361 of the outer part 301, such that the inner part 302 can be received within the inner compartment of outer part 301, while having the outer circumference of the motor end plate 37*a* and the flange bracket 38*a* fixedly welded to the inner surface of the casing cover 361. Rims 371 and 381 are respectively formed the outer circumferences of the motor end plate 37*a* and the flange bracket 38*a* for facilitating the welding process (brazing preferred). Since the outer part 301 and inner part 302 of the body are made separately, therefore it is possible to apply sheet metals of different material or having different thickness on different parts 301, 302. For example, the outer part 301 of the body may be made by a sheet metal having greater thickness and higher strength and toughness so as to support greater forces and stresses (especially at the inlet 32*a* section).

An example for fabricating the body shown in FIG. 7 may comprise the following steps:

a. using at least one set of geometric shape roller dies for roll forming a cylinder-shaped first sheet metal to form an inner part which includes at least a motor end plate, a neck portion and a flange bracket.

b. stamping (or deep drawing) a second sheet metal (preferably a stainless or alloy steel) to produce an outer part which includes at least a disk-shaped inlet end plate having an inlet opening at center thereof, a passage side plate and an extended cylindrical reinforcement casing cover; wherein the casing cover possesses a slightly larger diameter for accommodating the inner part.

c. forming an outlet opening at a suitable position in the passage side plate.

d. receiving the inner part within the casing cover of the outer part and having the outer circumferences of the motor end plate and flange bracket fixedly welded to the inner surface of the casing cover so as to form the integral body of sheet metal pump casing.

After finishing fabrication of the body, the following steps can be further proceeded to complete the fabrication of the sheet metal pump casing:

e. welding the guide plate, annular constraint member and pump wear ring to the inside wall of the body.

f. welding the inlet flange and the first flap flange on the outside wall near the inlet and welding the outlet flange and the second flap flange on the outside wall of the body near the outlet.

The descriptions and preferred embodiments set forth above are only to serve for illustrative purpose, and do not intent to limit the scope of this invention. Various changes and modifications may occur to those skilled in the art. For instance, fabrication of the inlet and outlet may be performed before or after roll forming of the pump body.

Accordingly, the appended claims are intended to cover all embodiments which do not depart from the spirit and scope of the invention.

What is claimed is:

1. A method of fabricating a pump casing having an inlet, an outlet and a pump casing body, the pump casing body having a neck portion defining a groove, and the method comprising the steps of:

(a) stamping a sheet metal to form a basin-shaped body and stamping the center portion of the basin-shaped body to form the inlet;

(b) centering the basin-shaped body about a first axis and using at least one set of roller dies to roll form the basin-shaped body into a pump casing body, which, starting from the inlet, includes an inlet end plate, a passage side plate, a motor end plate and the neck portion; and (c) stamping the passage side plate to form the outlet (d) wherein said set of roller dies include an internal roller die and a mating external roller die, both being rotatably mounted along second and third axes, respectively, said first, second, and third axes being parallel to but spaced from each other;

(e) further wherein said internal roller die contains a trough portion and said external roller die contains a flange portion so as to form the neck portion of the casing body.

2. The method of fabricating a pump casing of claim 1 further including the steps of:

(f) welding a guide plate, an annular constraint member and a pump wear ring to the inside wall of the pump casing body; and (g) welding an inlet flange to the outside wall of the pump casing body around the inlet and an outlet flange to the outside wall of the body around the outlet.

3. The method of fabricating a pump casing of claim 1, wherein the set of roller dies includes an internal roller die and a mating external roller die for holding the sheet metal therebetween, the internal and external roller die rotating and approaching each other to press the sheet metal;

wherein the internal roller die has at least a side section for forming the passage side plate and a trough section for forming the neck, and a connection section between the side and trough section for forming the motor end plate.

4. The method of fabricating pump casing of 1, wherein the inlet end plate is formed into a disk shape by stamping.

5. The method of fabricating pump casing of 1, wherein the inlet and outlet are formed by stamping.

6. A method of fabricating a pump casing, comprising the steps of:

(a) centering a cylinder-shaped first sheet metal along a first axis, using at least one set of roller dies to roll form the cylinder-shaped first sheet metal into an integral inner part, which includes a motor end plate, a neck portion connected to said motor end plate and a flange bracket connected to said neck portion, said neck portion defines a groove;

(b) processing a second sheet metal to produce an integral outer part which includes at least a disk-shaped inlet end plate having an inlet opening formed thereon, a passage side plate connected to an outer circumference of said inlet end plate and a casing cover connected to said passage side plate, said casing cover having an inner compartment sufficient to accommodate the inner part;

(c) forming an outlet opening at a suitable position in the passage side plate;

(d) receiving the inner part within the casing cover of the outer part and having outer circumferences of the motor end plate and flange bracket fixedly welded to inner surface of the casing cover to form an integral pump casing body (e) wherein said set of roller dies include an internal roller die and a mating external roller die, both being rotatably mounted along second and third axes, respectively, said first, second, and third axes being parallel to but spaced from each other;

(f) further wherein said internal roller die contains a trough portion and said external roller die contains a flange portion so as to form the neck portion of the casing body.

7. The method of fabricating a pump casing of claim 6, wherein the set of roller dies includes an internal roller die and a mating external roller die for holding the sheet metal therebetween, the internal and external roller die rotating and approaching each other to press the sheet metal;

wherein the internal roller die has at least a side section, a trough section for forming the neck portion, and a connection section between the side and trough section for forming the motor end plate.

8. The method of fabricating pump casing of 6, wherein the method for processing the second sheet metal to produce said integral outer part is stamping.

9. The method of fabricating pump casing of 6, wherein the method for processing the second sheet metal to produce said integral outer part is deep drawing.

10. The method of fabricating a pump casing of claim 6 further including the steps of:

(g) welding a guide plate, an annular constraint member and a pump wear ring to an inside wall of the body; and (h) welding an inlet flange to an outside wall of the body around the inlet and an outlet flange to the outside wall of the body around the outlet.

* * * * *